US005850999A

United States Patent [19]

Gross

[11] Patent Number: 5,850,999

[45] Date of Patent: Dec. 22, 1998

[54] LIGHT COVER QUICK AND SAFE RELEASE DEVICE

[76] Inventor: Robert Eugene Gross, 22525 Adams Dr., Robertsdale, Ala. 36567-6156

[21] Appl. No.: 689,671

[22] Filed: Aug. 13, 1996

[51] Int. Cl.[6] ..... B42F 13/00

[52] U.S. Cl. ..... 248/342; 248/343; 362/368; 403/106

[58] Field of Search ..... 248/342, 343, 248/317, 318; 362/368, 369, 277; 403/349, 348, 106, 104; 24/129 A, 115 H; 464/901

[56] References Cited

U.S. PATENT DOCUMENTS

| | | | |
|---|---|---|---|
| 2,735,000 | 2/1956 | Wilson et al. | 248/343 X |
| 3,381,126 | 4/1968 | Steiner | 362/368 |
| 4,076,105 | 2/1978 | Aono | 403/349 X |
| 4,088,293 | 5/1978 | Delmore | 248/500 |
| 4,155,111 | 5/1979 | Kelly et al. | 362/374 |
| 4,175,282 | 11/1979 | Grindle et al. | 248/500 |
| 4,424,554 | 1/1984 | Woloski et al. | 362/365 |
| 4,497,014 | 1/1985 | Woloski et al. | 362/150 |
| 4,531,179 | 7/1985 | Baker | 362/368 X |
| 4,593,344 | 6/1986 | Basile | 248/500 |
| 4,941,071 | 7/1990 | Knauf | 362/368 X |
| 5,002,418 | 3/1991 | McCown et al. | 403/349 X |
| 5,263,788 | 11/1993 | Moriel | 248/500 |

*Primary Examiner*—William Stryjewski
*Attorney, Agent, or Firm*—Patent & Trademark Services; Joseph H. McGlynn

[57] ABSTRACT

An improved light cover mounting device is disclosed. A housing, capable of attachment to a light fixture, contains a compression spring and a spring-biased, retractable retaining rod. The retaining rod extends through the screw hole of a conventional light cover arrangement and engages the recessed portion of the light cover. A roll pin, projecting laterally through the housing and the retaining rod, is held at either end by L-shaped openings on the housing. The roll pin holds the compression spring inside the housing and may be hooked into the locking portion of the L-shaped openings to hold the retaining rod in the retracted position.

8 Claims, 1 Drawing Sheet

FIG. 1
PRIOR ART
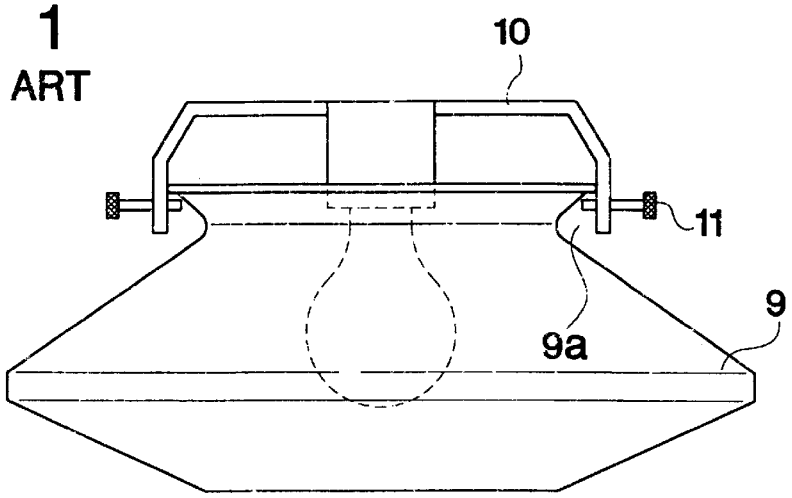
FIG. 2
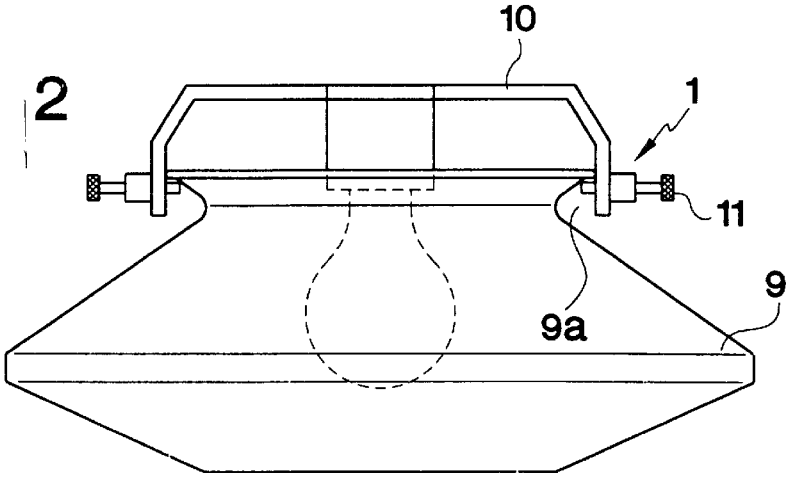
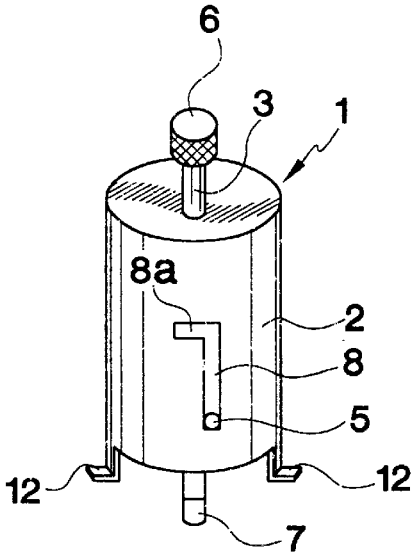
FIG. 3
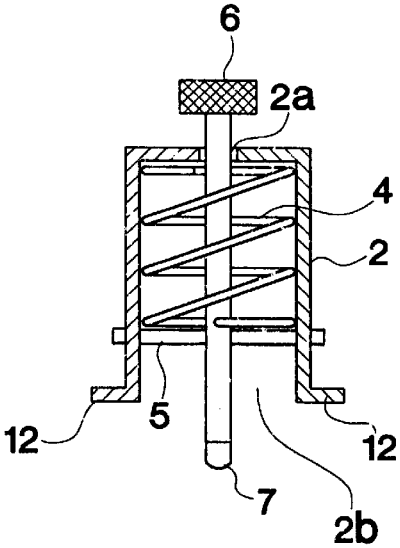
FIG. 4

LIGHT COVER QUICK AND SAFE RELEASE DEVICE

BACKGROUND OF THE INVENTION

The present invention relates generally to lighting fixtures, and particularly to a readily releasable device for securing the globe cover of a light fixture.

Description of the Prior Art

A typical arrangement found in homes across the country is the screw-type attachment for light fixture covers. In this arrangement, the upper edge of a light cover is secured to the light fixture by means of screws threaded through the side of the fixture. The screws are received into openings on the upper edge of the light cover, or else into a circumferential recess formed at the top of the cover.

The problems with this arrangement are numerous. First, the screws often become stuck or cross-threaded, causing a great deal of difficulty in removing the cover. The screws can also become loosened over time by nornal household vibrations, posing the danger of the cover falling on someone. If the screws are tightened too much, the light cover can also break or chip.

A number of devices have been disclosed in the prior art to improve the convenience and safety of light fixture arrangements. However, these devices have not provided satisfactory solutions to the problems created by the screw-type light cover arrangement.

For example, U.S. Pat. No. 4,593,344 discloses a light fixture for retaining parabolic aluminized reflectors, comprising spring members for receiving the flange portion of a reflector fixture. This invention is specifically designed for use on the "par can" type reflectors used in the entertainment industry, and is not adaptable for use on the common household screw-type light cover. It is far too bulky and unattractive, having a visible cam release lever which further detracts from its desirability for household use.

U.S. Pat. No. 5,263,788 describes a fastening device for a light cover, comprising a sleeve with radially movable projections that are capable of snapping into recesses on a light cover. This invention, as well, is not readily adaptable to household use because it requires installation of an entirely new type of light fixture and cover. It cannot be used as a substitute for existing screw- type cover devices.

U.S. Pat. Nos. 4,088,293 and 4,175,282 provide further examples of prior art inventions which, while enhancing the convenience and safety of certain types of light fixtures, have nevertheless failed to provide a satisfactory alternative for existing screw-type light cover arrangements. The '293 Patent discloses a retaining clip for securing light fixtures suspended from an acoustic ceiling, while the '282 Patent describes a device for use on hazardous-duty luminaries with a threaded-collar type attachment.

Clearly, there remains a need for a light fixture device capable of alleviating the inconvenience and danger of screw-type cover arrangements, without requiring the installation of an entirely new light fixture. The present invention, described fully below, provides an inexpensive and convenient replacement device for the screws on such cover arrangements. In use, the invention provides for quick and simple removal and installation of a light cover, thereby avoiding the difficulties and hazards posed by the conventional cover attachment.

SUMMARY OF THE INVENTION

The present invention is an attachment device for light covers, comprising a retractable, spring biased retaining rod contained within a housing. The housing may be attached at the screw hole of a conventional light fixture, allowing the retaining rod to protrude through the hole and engage the opening or recessed portion of a light cover. The retaining rod may be manually retracted to disengage it from the light cover, thereby releasing the light cover from the fixture. The invention thus eliminates the often time consuming and difficult task of turning a plurality of screws to release the light cover from the fixture.

Accordingly, it is an object of this invention to provide an improved light cover retaining device.

It is a further object of this invention to provide a light cover retaining device which eliminates the difficulty and dangers associated with screw-type light cover arrangements.

It is a further object of this invention to provide a light cover retaining device that can readily replace the screws on existing household light cover arrangements.

These and other objects and advantages of the present invention will become readily apparent from the detailed description below, when taken in conjunction with the annexed drawings.

BRIEF DESCRIPTION OF THE DRAWINGS

FIG. 1 depicts a side view of the conventional screw-type light cover arrangement commonly used in the prior art.

FIG. 2 depicts a side view of the present invention as used on a conventional light cover arrangement.

FIG. 3 shows a perspective view of the present invention.

FIG. 4 shows a cross-sectional view of the present invention.

DESCRIPTION OF THE PREFERRED EMBODIMENT

Referring now to the drawings in greater detail, FIG. 1 illustrates the conventional, screw-type light cover attachment found in many households. As shown in FIG. 1, a light cover 9 is held to a light fixture 10 by screws 11 (usually three) which are threaded through the side of the fixture 10. The screws 11 are received by a circumferential grooved recess 9*a* near the top edge of the light cover 9. Some light covers have holes in lieu of the recessed portion, but the end result is the same.

Under this arrangement, removal of the light cover 9 requires removal or loosening of at least two of the screws 11. This procedure is often complicated by cross-threading or corrosion of the screws. Moreover, if the screws are put in too tightly, the cover may break or chip. If the screws are put in too loosely, on the other hand, the cover is likely to fall.

FIG. 2 depicts the attachment of a light cover 9 using the attachment device of the present invention 1, described below.

As shown in FIGS. 3 and 4, the present invention 1 comprises a housing 2, shown in FIGS. 3 and 4 as a hollow, cylindrical member with an open bottom at 2*b* and a top opening 2*a* for receiving a retaining rod 3. As shown in FIG. 3, the housing has a generally L-shaped opening 8 on its side. The housing 2 has an identical opening (not shown) on its opposite side, diametrically opposed to the opening 8 shown in FIG. 3. The housing 2 is further provided with radially extending tabs 12 on its bottom edge, the function of which is described below.

As shown FIGS. 3 and 4, a retaining rod 3 projects longitudinally through opening 2*a* in the top of the housing 2. The retaining rod 3 has at its upper end a handle 6, which may be knurled around its outer circumference, and at its opposite end a soft cap 7 of rubber or some similar material.

The handle 6 is of a larger diameter than the retaining rod 2 so that it may not pass through the top opening 2*a* of the housing 2. The retaining rod 3 is also of greater length than the housing 2, so that the cap 7 extends roughly one-half inch from the open bottom 2*a* of the housing 2.

A compression spring 4 is fitted into the housing 2, and is retained therein by means of a roll pin 5 projecting laterally through the housing 2' and the top of the housing 2. The L-shaped openings 8 of the housing 2 receive the roll pin 5. The roll pin 5 is of a length slightly greater than the width of the housing 2, so that the ends of the roll pin 5 extend slightly from the L-shaped openings 8, 8*a*.

The roll pin 5 may move freely in the longitudinal direction of the L-shaped openings 8, but lateral movement of the roll pin 5 is prevented by one of a number of means. In the preferred form, the hole 3*a* of the retaining rod 3 has circumferential grooved portions interlocking with corresponding grooves on the roll pin 5, creating a fit which prevents lateral movement of the roll pin 5. Of course, other means of preventing lateral travel of the roll pin 5 may be used without departing from the scope of the invention. For example, the roll pin could be fitted with stop washers on either side of the retaining rod hole 3*a*, or any other conventional means which will hold the pin 5 in place with respect to the rod 3, can be used.

As shown in FIG. 2, the invention 1 may be attached to a light fixture 10 to releasably hold a light cover 9 thereon. The tabs 12, on the bottom edge of the housing 2, may be riveted, spot welded, or secured by any other suitable means to the light fixture 10 such that the retaining rod 3 projects into the screw hole on the fixture. The retaining rod 3 is biased by the compression spring 4 such that the tip 7 of the retaining rod 3 engages the recessed portion 9*a* of the light cover 9. The tip 7 is constructed from soft rubber or some similar material so that the danger of chipping or breaking the light cover is avoided.

The retaining rod 3 may be retracted to disengage the recessed portion 9*a* of the light cover 9 by pulling the handle 6. The retaining rod 3 may be locked into the retracted position by pulling the handle 6 until the roll pin 5 moves into the short locking portion 8*a* of the L-shaped openings 8 on the housing 2. In the preferred form, the locking portion 8*a* is at an angle slightly less than 90 degrees relative to the longer portion of the opening 8. Such angling would prevent the roll pin 5 from slipping out of the locking portion 8*a* when the retaining rod 3 is locked into the retracted position.

In use, the invention 1 provides the means to rapidly and conveniently install and remove a light cover. The invention eliminates the time consuming task of turning screws and replaces it with the simple procedure of pulling a handle, The invention also avoids damage to the light cover and obviates the danger of the cover becoming loose and falling. The invention may be constructed inexpensively from aluminum or any other material which will not be damaged by the heat of the light fixture.

Although the light cover mounting device and the method of using the same according to the present invention has been described in the foregoing specification with considerable details, it is to be understood that modifications may be made to the present invention which do not exceed the scope of the appended claims and modified forms of this invention done by others skilled in the art to which the invention pertains will be considered infringements of this invention when those modified forms fall within the claimed scope of the invention.

What I claim as my invention is:

1. A light with a light cover retained on a light fixture by a retaining device, wherein said retaining device comprises:

a housing having an open bottom and a partially open top and sides, securing means for attaching said housing to the light fixture attached adjacent said open bottom, a rod extending through said partially open top, and through said open bottom, resilient means surrounding said rod for biasing said rod toward said open bottom, means on said rod to prevent said rod from being disengaged from said housing by said resilient means, means on said side of said housing for holding said rod in a first and second position, in said first position said rod projects from said open bottom, and in said second position said rod is retracted into said housing.

2. The retaining device for securing a light cover to a light fixture as claimed in claim 1, wherein said securing means for attaching said housing to a light fixture is a plurality of tabs.

3. The retaining device for securing a light cover to a light fixture as claimed in claim 1, wherein said resilient means surrounding said rod for biasing said rod toward said open bottom is a coil spring.

4. The retaining device for securing a light cover to a light fixture as claimed in claim 1, wherein said means on said rod to prevent said rod from being disengaged from said housing by said resilient means is an enlargement on said rod.

5. The retaining device for securing a light cover to a light fixture as claimed in claim 1, wherein said means on said side of said housing for holding said rod in a first and second position is a slot having a first part and a second part, which extend through said housing, said first part of said slot extending substantially parallel to a longitudinal axis of said housing, and said second part of said slot extending substantially perpendicular to a longitudinal axis of said housing.

6. The retaining device for securing a light cover to a light fixture as claimed in claim 1, wherein said rod has a pin extending therethrough, said pin being permanently mounted to said rod, at least one end of said pin extending into said slot and cooperating with said slot to hold said rod in said first and second positions.

7. The retaining device for securing a light cover to a light fixture as claimed in claim 1, wherein said rod has a soft portion attached to one end.

8. A light with a light cover retained on a light fixture by a retaining device, wherein said retaining device comprises:

housing having an open bottom anda partially open top and side, securing means for attaching said housing to the light fixture attached adjacent said open bottom, a rod extending through said partially open top, and through said open bottom, said rod having a first end which is positioned outside of said housing, and said rod having a second end which is, in a first position, outside of said housing, and in a second position said rod second end is completely inside said housing, resilient means surrounding said rod for biasing said rod toward said open bottom, means on said rod to prevent said rod from being disengaged from said housing by said resilient means, means on said side of said housing for holding said rod in said first and second position.

* * * * *

UNITED STATES PATENT AND TRADEMARK OFFICE

CERTIFICATE OF CORRECTION

PATENT NO. : 5,850,999
DATED : December 22, 1998
INVENTOR(S) : Robert Eugene Gross It is certified that error appears in the above-identified patent and that said Letters Patent is hereby corrected as shown below:

On the Title Page, the inventor's address should be changed to

4091 Ronald Ave.
Loxley, AL 36551

Signed and Sealed this

Thirtieth Day of March, 1999

*Attest:*

Q. TODD DICKINSON

*Attesting Officer*

*Acting Commissioner of Patents and Trademarks*